US008330694B2

(12) United States Patent
Abe

(10) Patent No.: US 8,330,694 B2
(45) Date of Patent: Dec. 11, 2012

(54) LIQUID CRYSTAL DISPLAY APPARATUS

(75) Inventor: Masayuki Abe, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 1128 days.

(21) Appl. No.: 12/132,717

(22) Filed: Jun. 4, 2008

(65) Prior Publication Data

US 2008/0309837 A1 Dec. 18, 2008

(30) Foreign Application Priority Data

Jun. 12, 2007 (JP) ..... 2007-154727

(51) Int. Cl.
*G09G 3/36* (2006.01)

(52) U.S. Cl. ..... 345/95; 345/87; 345/90; 345/94; 345/204; 349/33; 349/34; 349/37

(58) Field of Classification Search ..... 345/100, 345/87–97, 204; 349/54, 124, 149, 33–37
See application file for complete search history.

(56) References Cited

U.S. PATENT DOCUMENTS

| | | | | |
|---|---|---|---|---|
| 5,933,202 | A * | 8/1999 | Watanabe et al. | 349/33 |
| 6,462,796 | B1 * | 10/2002 | Kabe et al. | 349/124 |
| 6,507,330 | B1 | 1/2003 | Handschy et al. | |
| 6,803,976 | B1 * | 10/2004 | Fujioka et al. | 349/54 |
| 6,927,830 | B2 * | 8/2005 | Chung et al. | 349/149 |
| 8,068,079 | B2 * | 11/2011 | Kawahara | 345/95 |
| 8,081,153 | B2 * | 12/2011 | Shirasaka et al. | 345/100 |
| 2002/0036607 | A1 * | 3/2002 | Takahashi et al. | 345/87 |
| 2006/0256245 | A1 * | 11/2006 | Verschueren et al. | 349/33 |
| 2009/0102765 | A1 * | 4/2009 | Kawahara | 345/87 |

FOREIGN PATENT DOCUMENTS

| | | | |
|---|---|---|---|
| EP | 854465 | A1 | 7/1998 |
| EP | 1055960 | | 11/2000 |
| GB | 2429823 | A | 3/2007 |
| JP | 05-032336 | A | 2/1993 |
| JP | 08-201830 | A | 8/1996 |
| JP | 11-038389 | A | 2/1999 |
| JP | 2003075801 | A | 3/2003 |
| JP | 2005-055562 | A | 3/2005 |
| KR | 10-2005-0018288 | | 2/2005 |
| TW | 200305760 | A | 11/2003 |
| TW | 200609580 | A | 3/2006 |
| WO | WO 2005/012986 | A1 | 2/2005 |

OTHER PUBLICATIONS

EP OA for application No. 08009818.9 dated Apr. 24, 2011. Taiwanese Office Action dated Sep. 3, 2012; Original Office Action and English Translation (7 pages) submitted.

* cited by examiner

*Primary Examiner* — Lun-Yi Lao
*Assistant Examiner* — Gregory J Tryder
(74) *Attorney, Agent, or Firm* — Canon USA Inc IP Division

(57) ABSTRACT

The liquid crystal display apparatus includes a liquid crystal modulation element including first and second electrode, a liquid crystal layer disposed between the first and second electrodes, a first alignment film disposed between the first electrode and the liquid crystal layer, and a second alignment film disposed between the second electrode and the liquid crystal layer. The apparatus further includes a controller that respectively provides first and second electric potentials to the first and second electrodes such that a sign of an electric field generated in the liquid crystal layer is cyclically inverted in a modulation operation state. The controller respectively provides third and fourth electric potentials to the first and second electrodes such that the sign of the electric field is fixed in a state other than the modulation operation state. The apparatus can avoid an influence by cumulated charged particles without adding a new member.

6 Claims, 11 Drawing Sheets

LIQUID CRYSTAL DISPLAY APPARATUS

BACKGROUND OF THE INVENTION

The present invention relates to a liquid crystal display apparatus using a liquid crystal modulation element, such as a liquid crystal projector.

Some of the liquid crystal modulation elements are realized by sealing nematic liquid crystal having positive dielectric anisotropy between a first transparent substrate having a transparent electrode (common electrode) formed thereon and a second transparent substrate having a transparent electrode (pixel electrode) forming pixels, wiring, switching elements and the like formed thereon. The liquid crystal modulation element is referred to as a Twisted Nematic (TN) liquid crystal modulation element in which the major axes of liquid crystal molecules are twisted by 90 degrees continuously between the two glass substrates. This liquid crystal modulation element is used as a transmissive liquid crystal modulation element.

Some of the liquid crystal modulation elements utilize a circuit substrate having reflecting mirrors, wiring, switching elements and the like formed thereon instead of the above-mentioned second transparent substrate. This is called a Vertical Alignment Nematic (VAN) liquid crystal modulation element in which the major axes of liquid crystal molecules are aligned in homeotropic alignment substantially perpendicularly to two substrates. The liquid crystal modulation element is used as a reflective liquid crystal modulation element.

In these liquid crystal modulation elements, typically, Electrically Controlled Birefringence (ECB) effect is used to provide retardation for a light wave passing through a liquid crystal layer to control the change of polarization of the light wave, thereby forming an image with light.

In the liquid crystal modulation element, which utilizes the ECB effect to modulate the light intensity, application of an electric field to the liquid crystal layer moves charged particles (ionic substances) present in the liquid crystal layer. When a direct electric field is continuously applied to the liquid crystal layer, the charged particles are drawn toward one of two opposite electrodes. Even when a constant voltage is applied to the electrodes, the electric field substantially applied to the liquid crystal layer is attenuated or increased by the charge of the charged particles.

To avoid such a phenomenon, a line inversion drive method is typically employed in which the polarity of an applied electric field is reversed between positive and negative polarities for each line of arranged pixels and is changed in a predetermined cycle such as 60 Hz or the like. In addition, a field inversion drive method is used in which the polarity of an applied electric field to all of arranged pixels is reversed between positive and negative polarities in a predetermined cycle. These drive methods can avoid the application of the electric field of only one polarity to the liquid crystal layer to prevent unbalanced ions.

This corresponds to controlling the effective electric field to be applied to the liquid crystal layer such that it always has the same value as the voltage to be applied to the electrodes.

However, the liquid crystal layer, and an outer wall member surrounding the liquid crystal layer and the like also include thereinside charged particles. When the liquid crystal is driven in a high temperature environment in particular, these charged particles drift (or move) in the liquid crystal layer. These charged particles generate a direct electric field component in the liquid crystal layer, and attach to an interface between the liquid crystal layer and an alignment film or an electrode. Then, the charged particles drift and accumulate in a direction along which the liquid crystal molecules are aligned.

In a liquid crystal modulation element having an organic alignment film, in addition to the charged particles drifted due to the drive of the liquid crystal under the high temperature environment, light entering the liquid crystal modulation element causes decomposition of organic materials forming the alignment film, the liquid crystal, a seal member or the like, causing charged particles. These charged particles also generate the direct electric field component in the liquid crystal layer, attach to the interface between the liquid crystal layer and the alignment film or the electrode, and then drift and accumulate in the direction along which the liquid crystal molecules are aligned.

The charged particles that have accumulated in a specific area in the liquid crystal layer change an effective electric field applied to the liquid crystal layer, thereby preventing an expected ECB modulation. This causes, for example, luminance unevenness in an effective display area of the liquid crystal modulation element, which deteriorates image quality.

Countermeasures against such a problem has been disclosed in Japanese Patent Laid-Open Nos. 2005-55562, 8-201830, 11-38389, and 5-323336.

Japanese Patent Laid-Open No. 2005-55562 has disclosed a method in which at least one of electric potentials of the pixel electrode and the electrode opposite thereto of a liquid crystal cell is set to a ground level during a period other than an image display operation such that ions causing a burn-in phenomenon are dissociated from the interface between the liquid crystal layer and the alignment film or the electrodes.

Japanese Patent Laid-Open No. 8-201830 has disclosed a method in which an ion trap electrode area is provided in a non-display area of a liquid crystal modulation element, and a direct voltage is applied to the ion trap electrode such that ionic impurities are absorbed by the ion trap electrode area of the non-display area having no influence on image display.

Japanese Patent Laid-Open No. 11-38389 has disclosed a method in which a metal film electrode is provided at a position different from that of the pixel electrode to apply a direct voltage between the metal film electrode and a common electrode, thereby reducing the concentration of movable ions in a display area to suppress a flicker phenomenon.

Furthermore, Japanese Patent Laid-Open No. 5-323336 has disclosed a method in which ion trap electrodes are provided independently of a transparent electrode at opposing surfaces of two electrode substrates provided at the vicinity of a liquid crystal enclosing portion, and a voltage is applied to the ion trap electrodes to trap ionic impurities.

As described above, the voltage control from the outside can control the charged particles in the liquid crystal modulation element to provide a good quality of displayed images.

However, the method disclosed in Japanese Patent Laid-Open No. 2005-55562 needs in a circuit of the liquid crystal modulation element a switching part for setting the electric potential of the opposite electrodes to the ground level. This increases the number of steps of manufacturing the liquid crystal modulation element.

Furthermore, the setting of the electric potential of the opposite electrodes to the ground level is not sufficiently effective because forces for pulling off the ions that have attached to the interface of the liquid crystal layer and the alignment film or the electrode are weaker than coulomb forces.

Similarly, the methods disclosed in Japanese Patent Laid-Open Nos. 8-201830, 11-38389, and 5-323336 also need to newly provide the ion trap electrode for attracting the ions in the non-display area, so that the number of the manufacturing steps increases. Moreover, although in these disclosed methods the ionic impurities are drawn by the coulomb force, the coulomb force is inversely proportional to the square of a distance from the ion trap electrode, so that the ions generated at a position away from the ion trap electrode cannot be efficiently attracted.

BRIEF SUMMARY OF THE INVENTION

The present invention provides a liquid crystal display apparatus that can avoid the influence by the accumulated charged particles in the liquid crystal layer without adding a new member such as the switching part or the ion trap electrode to the liquid crystal modulation element.

The present invention according to one aspect provides a liquid crystal display apparatus that includes a liquid crystal modulation element including a first electrode, a second electrode, a liquid crystal layer disposed between the first electrode and the second electrode, a first alignment film disposed between the first electrode and the liquid crystal layer, and a second alignment film disposed between the second electrode and the liquid crystal layer. The apparatus further includes a controller that respectively provides a first electric potential and a second electric potential to the first electrode and the second electrode such that a sign of an electric field generated in the liquid crystal layer is cyclically inverted in a modulation operation state of the liquid crystal modulation element. The controller respectively provides a third electric potential and a fourth electric potential to the first electrode and the second electrode such that the sign of the electric field generated in the liquid crystal layer is fixed in a state other than the modulation operation state.

The present invention according to one aspect provides an image display system including the liquid crystal display apparatus and an image supply apparatus that supplies image information to the liquid crystal display apparatus.

Other aspects of the present invention will become apparent from the following description and the attached drawings.

DETAILED DESCRIPTION OF THE EMBODIMENTS

Exemplary embodiments of the present invention will hereinafter be described with reference to the accompanying drawings.

Embodiment 1

Figure 1:
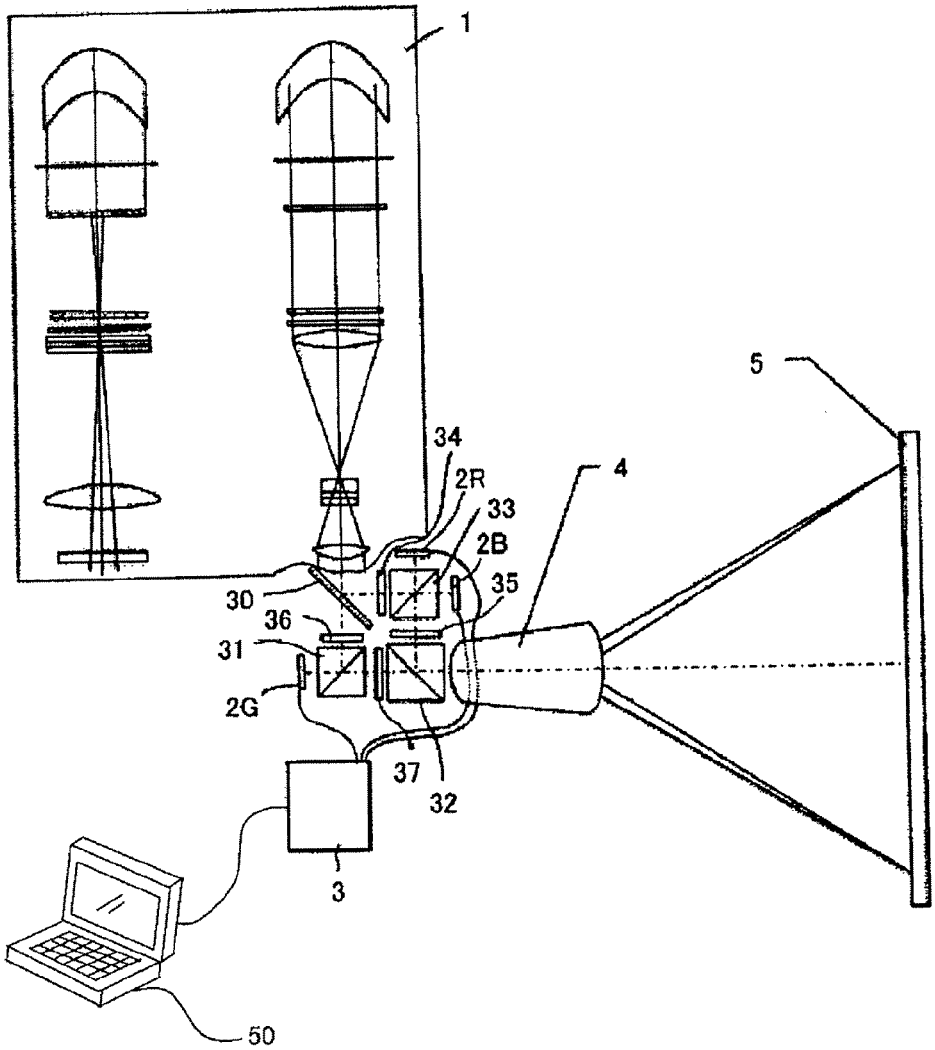
FIG. 1 shows the configuration of a liquid crystal projector that is first to fifth embodiments (Embodiments 1 to 5) of the present invention.

FIG. 1 shows the configuration of a liquid crystal projector (image projection apparatus) that is a first embodiment (Embodiment 1) of the present invention.

Reference numeral 3 denotes a liquid crystal driver serving as a controller. The liquid crystal driver 3 converts image information input from an image supply apparatus 50 such as a personal computer, a DVD player, and a television tuner into panel driving signals for red, green, and blue. The panel driving signals for red, green, and blue are respectively input to a liquid crystal panel 2R for red (R), a liquid crystal panel 2G for green (G), and a liquid crystal panel 2B for blue (B), all of which are reflective liquid crystal modulation elements. Thus, the three liquid crystal panels 2R, 2G, and 2B are individually controlled. The projector and the image supply apparatus 50 constitute an image display system.

The liquid crystal panels 2R, 2G, and 2B modulate light fluxes from an illumination optical system which will be described later (color-separated light fluxes) by modulation operations based on the panel driving signals. Thereby, the liquid crystal panels 2R, 2G, and 2B display images corresponding to R, G, and B components of the image information input from the image supply apparatus 50.

Reference numeral 1 denotes the illumination optical system. The top view thereof is shown on the left in a box in FIG. 1, and the side view thereof is shown on the right therein. The illumination optical system 1 includes a light source lamp, a parabolic reflector, a fly-eye lens, a polarization conversion element, a condenser lens, and the like, and emerges illumination light as linearly polarized light (S-polarized light) having an identical polarization direction.

The illumination light from the illumination optical system 1 enters a dichroic mirror 30 that reflects magenta light and transmits green light. A magenta light component of the illumination light is reflected by the dichroic mirror 30 and then is transmitted through a blue cross color polarizer 34 that provides retardation of one-half wavelength for blue polarized light. This produces a blue light component that is linearly polarized light (P-polarized light) having a polarization direction in parallel with the sheet of FIG. 1 and a red light component that is linearly polarized light (S-polarized light) having a polarization direction perpendicular to the sheet of FIG. 1.

The blue light component that is P-polarized light enters a first polarization beam splitter 33 and then is transmitted through its polarization splitting film toward the liquid crystal panel 2B for blue. The red light component that is S-polarized light enters the first polarization beam splitter 33 and then is reflected by its polarization splitting film toward the liquid crystal panel 2R for red.

The green light component that is S-polarized light and has transmitted through the dichroic mirror 30 passes through a dummy glass 36 provided for correcting an optical path length for green and then enters a second polarization beam splitter 31. The green light component (S-polarized light) is reflected by a polarization splitting film of the second polarization beam splitter 31 toward the liquid crystal panel 2G for green.

As described above, the liquid crystal panels 2R, 2G, and 2B for red, green, and red are illuminated with the illumination light.

Each of the liquid crystal panels provides retardation for the entering illumination light (polarized light) in accordance with the modulation state of pixels arranged on the liquid crystal panel and reflects the entering illumination light. Of the reflected light from each liquid crystal panel, a polarized light component having the same polarization direction as that of the illumination light is returned along the optical path of the illumination light toward the illumination optical system 1.

Of the reflected light from each liquid crystal panel, a polarized light component (modulated light) having a polarization direction perpendicular to that of the illumination light travels in the following manner.

The red modulated light from the liquid crystal panel 2R for red, which is P-polarized light, is transmitted through the polarization splitting film of the first polarization beam splitter 33 and then transmitted through a red cross color polarizer 35. The red cross color polarizer 35 provides retardation of one-half wavelength for red polarized light, so that the red P-polarized light is converted into S-polarized light by the red cross color polarizer 35. The red S-polarized light enters a third polarization beam splitter 32 and then is reflected by its polarization splitting film toward a projection lens 4.

The blue modulated light from the liquid crystal panel 2B for blue, which is S-polarized light, is reflected by the polarization splitting film of the first polarization beam splitter 33, is transmitted through the red cross color polarizer 35 without receiving any retardation and then enters the third polarization beam splitter 32. The blue S-polarized light is reflected by the polarization splitting film of the third polarization beam splitter 32 toward the projection lens 4.

The green modulated light from the liquid crystal panel 2G for green, which is P-polarized light, is transmitted through the polarization splitting film of the second polarization beam splitter 31, is transmitted through a dummy glass 37 provided for correcting an optical path length of green, and then enters the third polarization beam splitter 32. The green P-polarized light is transmitted through the polarization splitting film of the third polarization beam splitter 32 toward the projection lens 4.

The red modulated light, the blue modulated light, and the green modulated light are thus color-combined, and the color-combined light is projected by the projection lens 4 onto a light diffusion screen 5 that is a projection surface. Thereby, a full-color image is displayed.

The red liquid crystal panel 2R, the green liquid crystal panel 2G, and the blue liquid crystal panel 2B used in this embodiment are reflective liquid crystal modulation elements of a vertical alignment mode (a VAN type, for example).

Figure 2:
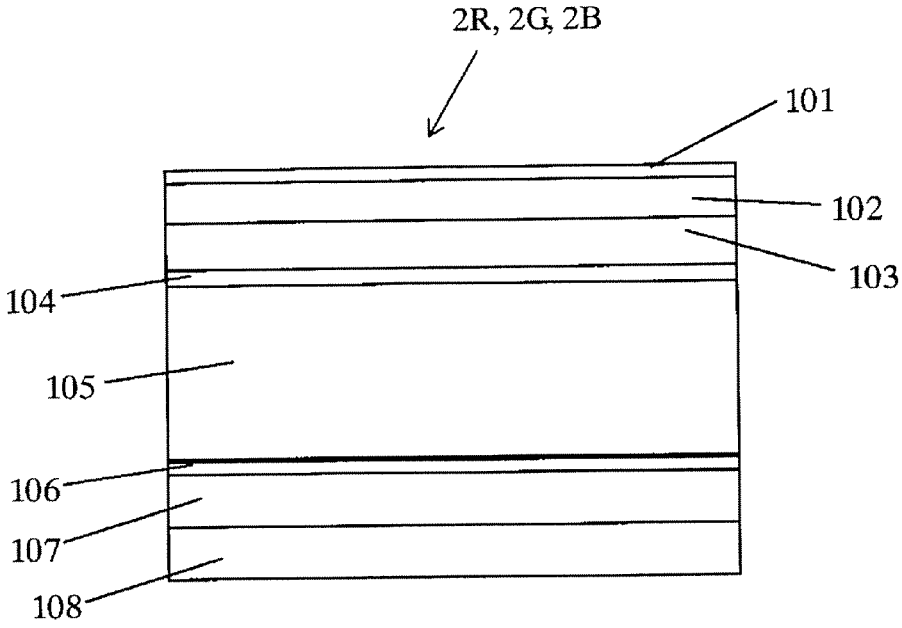
FIG. 2 is a cross-sectional view showing a liquid crystal panel used in Embodiments 1 to 5.

FIG. 2 shows a cross section of the structure of the liquid crystal panel which is common to the liquid crystal panel 2R for red, the liquid crystal panel 2G for green, and the liquid crystal panel 2B for blue. In order from a side into which light enters, reference numeral 101 denotes an anti-reflection coat film, and reference numeral 102 denotes a glass substrate. Reference numeral 103 denotes a transparent electrode film (first electrode) that is made of ITO, for example, and formed on the glass substrate 102. Reference numeral 104 denotes a first alignment film disposed between the transparent electrode film 103 and a liquid crystal layer, which will be described later. Reference numeral 105 denotes the liquid crystal layer disposed between the first alignment film 104 and a second alignment film 106. Reference numeral 107 denotes a reflective pixel electrode layer (second electrode) that is disposed on the opposite side of the liquid crystal layer 105 from the transparent electrode film 103 and is made of metal such as aluminum. Reference numeral 108 denotes an Si substrate on which the reflective pixel electrode layer 107 is formed. Hereinafter, the transparent electrode film 103 and the reflective pixel electrode layer 107 may be collectively called as electrode layers.

Figure 9:
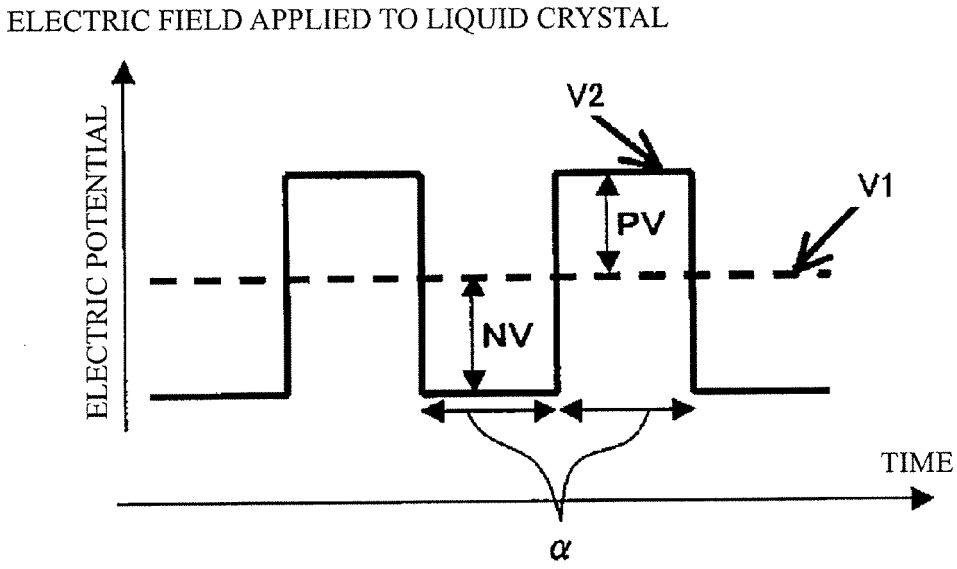
FIG. 9 shows alternating driving of the liquid crystal panel in Embodiment 1.

FIG. 9 shows an effective electric field generated in the liquid crystal layer 105 in response to control of the voltages applied to the electrode layers 103 and 107 performed by the liquid crystal panel driver 3 in a modulation operation state (liquid crystal driving state) for image display. In FIG. 9, the horizontal axis represents time and the vertical axis represents the effective electric field (electric potential difference) in the liquid crystal layer 105. The liquid crystal panel driver 3 stores therein a computer program. The liquid crystal panel driver 3 controls the voltages applied to the electrode layers 103 and 107 based on the program.

In the following description, the voltage applied to each electrode or the liquid crystal layer means an electric potential based on a ground level (0V), that is, an electric potential difference from the ground level.

A center value of an alternating electric potential applied to the reflective pixel electrode layer 107 is called as a center electric potential.

The voltage (electric field) provided to a reflective electrode side end of the liquid crystal layer 105 via the reflective pixel electrode layer 107 is an alternating voltage (shown by a solid line) V2 having a specific cycle α. The voltage (electric field) provided to a transparent electrode side end of the liquid crystal layer 105 via the transparent electrode film 103 is a direct voltage (shown by a broken line) V1. In the modulation operation state, the direct voltage provided to the transparent electrode film 103 corresponds to a first electric potential, and the alternating voltage provided to the reflective pixel electrode layer 107 corresponds to a second electric potential.

The effective electric field generated in the liquid crystal layer 105 depends on a difference between the alternating voltage V2 and the direct voltage V1, and it is an alternating electric field in which a positive electric field PV and a negative electric field NV alternately switch with the specific cycle α. Specifically, the electric potential difference generated in the liquid crystal layer 105 cyclically changes between positive and negative ones. In other words, the electric potential (electric potential difference) is provided to the electrode layers 103 and 107 such that a sign of the electric field generated in the liquid crystal layer 105 is cyclically inverted (that is, the sign cyclically changes between positive and negative ones). In the modulation operation state of the liquid crystal modulation element (or an image display state of the projector), the control of the voltages (electric potentials or electric field) described above is performed by the liquid crystal panel driver 3.

The specific cycle α corresponds to a cycle of one field, which is 1/120 second in the NTSC system and is 1/100 second in the PAL system. One frame image is displayed by two fields in 1/60 second or 1/50 second. However, the specific cycle α may correspond to a display cycle of one frame image.

The positive electric field PV and the negative electric field NV are generated by superposition of the voltages (electric fields) provided to the electrode layers 103 and 107, voltage drops due to resistances of the alignment films 104 and 106, and the minute voltages (electric fields) produced by electric charges (electric charges of electrons and holes) trapped by each alignment film.

Figure 3:
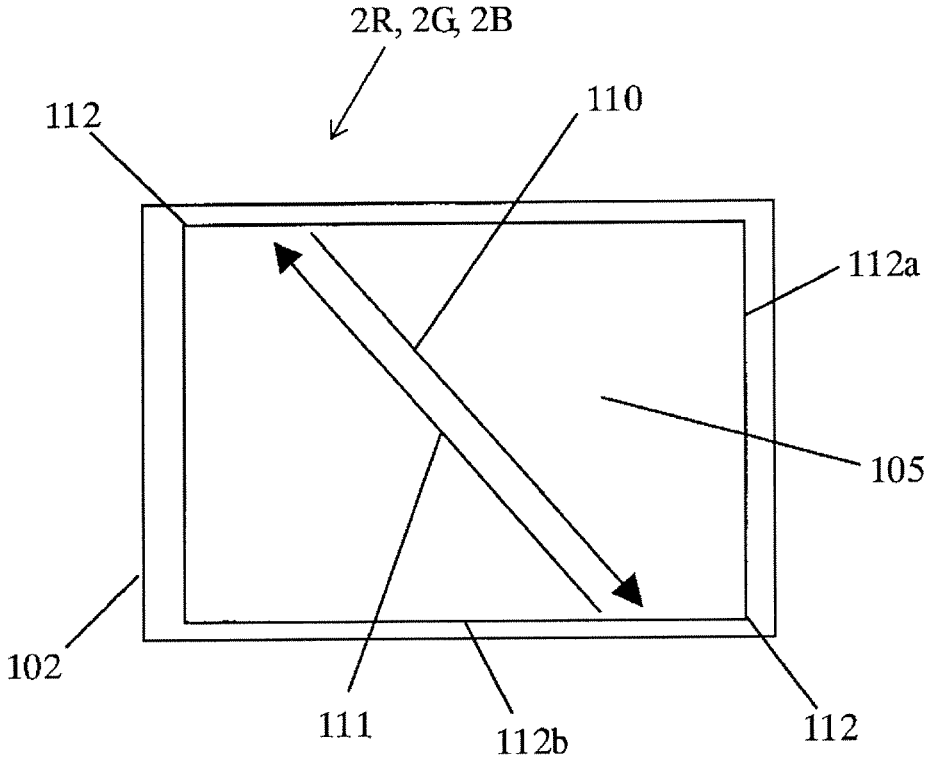
FIG. 3 shows a pretilt direction in the liquid crystal panel in its vertical alignment mode.

FIG. 3 shows the red liquid crystal panel 2R, the green liquid crystal panel 2G, and the blue liquid crystal panel 2B viewed from the glass substrate 102.

Reference numeral 110 denotes a direction of director orientation (pretilt direction) of liquid crystal molecules aligned by the first alignment film 104. Reference numeral 111 denotes a direction of director orientation (pretilt direction) of the liquid crystal molecules aligned by the second alignment film 106. Reference numeral 112 denotes an effective display area of the liquid crystal panel. The directions of director orientation 110 and 111 are both tilted by a few degrees with respect to the normal line of the alignment film surface and tilted in directions opposite to each other.

An alignment processing is performed on each alignment film in a direction of about 45 degrees with respect to a short side 112*a* and a long side 112*b* of the effective display area 112.

In the projector, light with a high intensity emitted from a lamp increases the temperature of the liquid crystal panels 2R, 2G, and 2B. The liquid crystal panels 2R, 2G, and 2B are controlled to have a temperature of about 40 degrees C. under a normal temperature operation environment. The use of the projector for a long time, however, causes the liquid crystal panels 2R, 2G, and 2B to be in a temperature rising state (high temperature state) for a long period. When this is combined with the drive of the liquid crystal molecules for image display, a disadvantage described below is caused.

Figure 4:
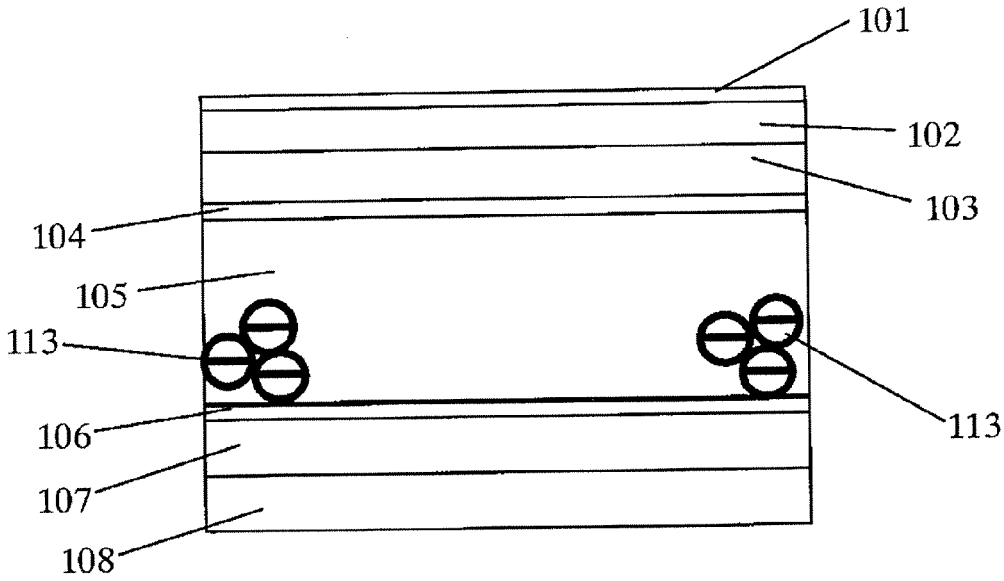
FIG. 4 is a cross-sectional view showing charged particles that have accumulated in the liquid crystal panel in Embodiment 1.
Figure 5:
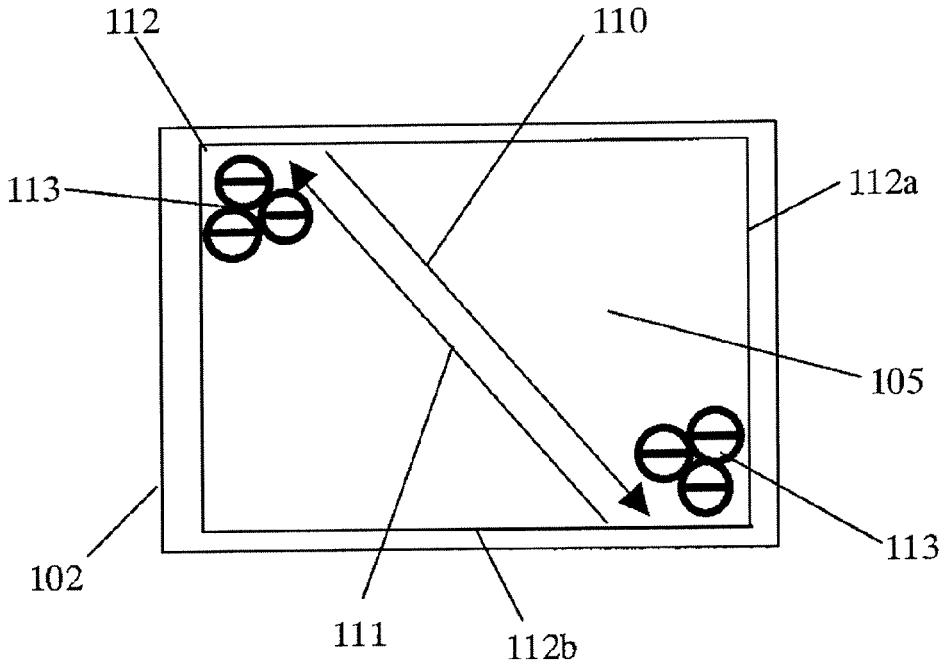
FIG. 5 shows the charged particles that have accumulated in the liquid crystal panel in Embodiment 1 viewed from a glass substrate side.

Specifically, charged particles 113 exist in the liquid crystal layer 105, in a seal material which is formed of an organic substance and is disposed at the vicinity of the liquid crystal layer 105, and at the vicinity of interfaces between the liquid crystal layer 105 and the first and second alignment films 104, 106 and between the first and second alignment films 104, 106 and the electrode layers 103, 107. As shown in FIGS. 4 and 5, the charged particles 113 proceed, during the long-time use, along the interface between the liquid crystal layer 105 and the second alignment film 106 disposed on the side of the reflective pixel electrode layer 107 in the direction of director orientation of the liquid crystal molecules, and then accumulate in diagonal areas in the effective display area 112 on the side of the second alignment film 106. In this case, the charged particles 113 have charges with a negative sign. FIG. 4 is a cross-sectional view showing the liquid crystal panel. FIG. 5 shows the liquid crystal panel viewed from the glass substrate 102.

Then, the charged particles 113 that have accumulated at the interface between the liquid crystal layer 105 and the second alignment film 106 as described above change the effective electric field generated in the liquid crystal layer 105. This deteriorates image quality in the area where the charged particles have accumulated.

In this embodiment, in order to suspend (unstick) such accumulated charged particles 113 from the interface between the liquid crystal layer 105 and the second alignment film 106 and the diagonal areas in the effective display area 112, the liquid crystal panel driver 3 controls the voltages applied to the electrode layers 103 and 107. This control of the applied voltage is performed in a state of the projector (hereinafter referred to as a non-modulating operation state) other than the modulation operation state. The non-modulating operation state means a state in which the above-described alternating electric field is not generated in the liquid crystal layer 105, that is, a state in which the first and second electric potentials are not provided to the electrode layers 103 and 107.

Figure 6:
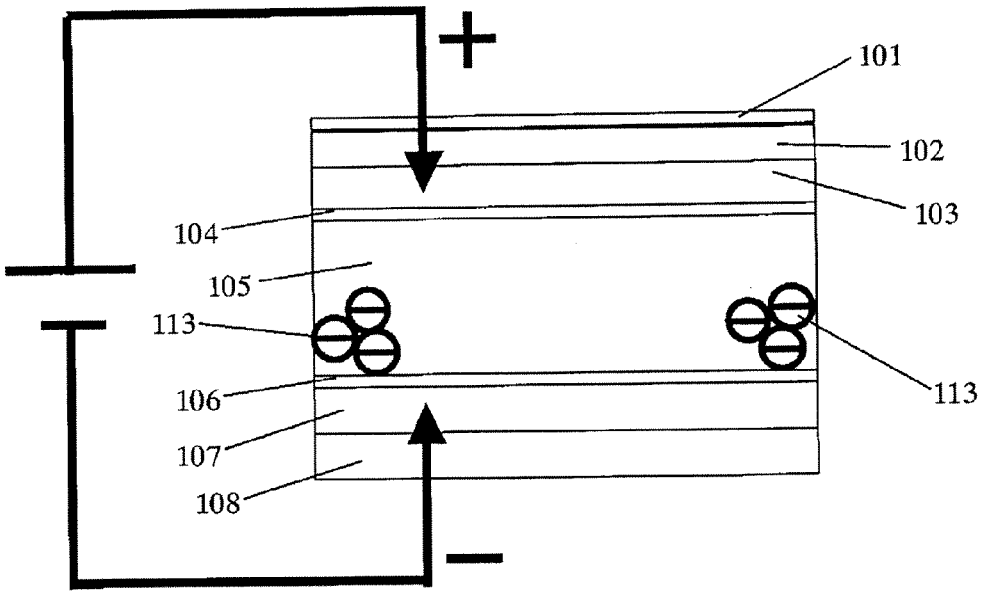
FIGS. 6 and 7 show voltages applied to opposite electrodes in the liquid crystal panel for suspending the charged particles in Embodiment 1.

First, as shown in FIG. 6, in order to suspend the accumulated charged particles 113 in the liquid crystal layer 105, a positive voltage (third electric potential) is applied to the transparent electrode film 103 and a negative voltage (fourth electric potential) is applied to the reflective pixel electrode layer 107. The voltage applied to the reflective pixel electrode layer 107 needs not necessarily to be a negative voltage. Specifically, when the voltage applied to the reflective pixel electrode layer 107 is compared with the voltage applied to the transparent electrode film 103, the voltage applied to the reflective pixel electrode layer 107 may be negative relative to the voltage applied to the transparent electrode film 103 though the signs of these voltages are the same.

In other words, the voltage applied to the reflective pixel electrode layer 107 may be lower than (or may be a minus side voltage with respect to) the voltage applied to the transparent electrode film 103. Both of the voltages applied to the reflective pixel electrode layer 107 and the transparent electrode film 103 may of course be positive voltages or negative voltages, and one of the voltages may be a positive voltage while the other may be a negative voltage, as long as the above-condition is satisfied. This is also applied to embodiments described later.

Figure 7:
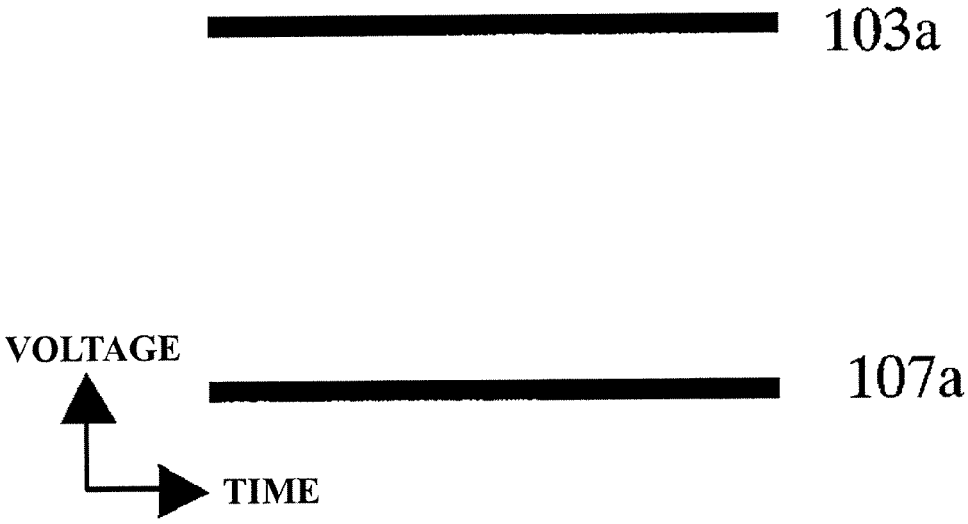

FIG. 7 shows the voltages 103*a* and 107*a* applied to the electrode layers 103 and 107. As can be seen from FIG. 7, the voltage (fourth electric potential) 107*a* applied to the reflective pixel electrode layer 107 is a negative voltage when compared with the voltage (third electric potential) 103*a* applied to the transparent electrode film 103.

The voltages 103*a* and 107*a* applied to the electrode layers 103 and 107 are fixed direct voltages that do not change with time. The "fixed voltage" herein also includes, in addition to a voltage not changing at all, a voltage changing only within a range where voltages changed due to variation in power supply voltage, control errors or the like can be regarded as an identical voltage. This also applies to embodiments described later.

The application of the voltages 103*a* and 107*a* generates a negative direct electric field that does not cyclically change between positive and negative ones in the liquid crystal layer 105. The strength of the direct electric field applied to the liquid crystal layer 105 may change as long as the direct electric field does not cyclically change between positive and negative ones.

Specifically, the voltages (electric potentials) applied to the electrode layers 103 and 107 may change, but the sign of the voltage (electric potential) applied to one of the electrode layers 103 and 107 with respect to that of the voltage (electric potential) applied to the other desirably does not change. In other words, the electric potential (electric potential difference) is provided to the electrode layers 103 and 107 such that the sign of the electric field generated in the liquid crystal layer is fixed (that is, the sign is fixedly positive or negative). In the non-modulating operation state other than the modulation operation state of the liquid crystal modulation element, such as a state where no image is displayed, a state in the middle of startup of the projector, a sleep state, a state in the middle of shutdown of the projector, or the like, the control of the voltage (in other words, electric potential or electric field) as described above is performed by the liquid crystal panel driver 3.

The voltages applied to the transparent electrode film 103 and the reflective pixel electrode layer 107 are identical to each other in an in-plane direction of the liquid crystal layer 105. The "in-plane direction of the liquid crystal layer 105" can also be said as a direction orthogonal to a thickness direction of the liquid crystal layer 105 or an in-plane direction of the display surface (or modulation surface) of the liquid crystal panel. However, the voltage applied to the area where the charged particles have accumulated in the liquid crystal layer may be higher (or the electric potential difference applied between the electrode layers may be larger) than that applied to the other area (or areas) where the charged particles less than those in the first area have accumulated.

Figure 8:
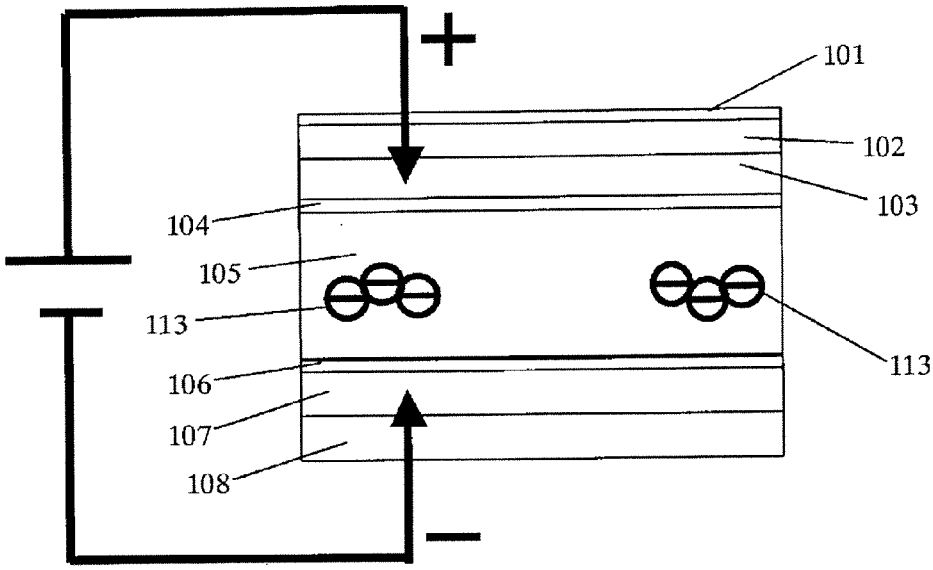
FIG. 8 shows the charged particles suspended by controlling the applied voltage in Embodiment 1.

In this embodiment, the control of the applied voltage described above is performed in the non-modulating operation state for a predetermined time. As a result, as shown in FIG. 8, the negative charged particles 113 that have attached to or accumulated at the interface between the liquid crystal layer 105 and the second alignment film 106 are dissociated from that interface by repulsion forces generated by their coulomb forces against the negative voltage applied to the reflective pixel electrode layer 107. Then, the negative charged particles 113 are suspended in the liquid crystal layer 105.

The "predetermined time" herein means a time required for causing the most part (e.g., 70% or more) or all of the accumulated charged particles 113 to be dissociated from the interface between the liquid crystal layer 105 and the second alignment film 106 and thus suspending them in the liquid crystal layer 105.

As described above, the voltage applied to the reflective pixel electrode layer 107 which is disposed on the side of the second alignment film 106 where the charged particles 113 accumulate at the interface between the second alignment film 106 and the liquid crystal layer 105 has the same negative sign as that of the charged particles 113.

According to this embodiment, the charged particles 113 that have accumulated at the interface between the liquid crystal layer 105 and the second alignment film 106 can be dissociated from that interface to suspend them in the liquid crystal layer 105. This can suppress deterioration of image quality due to the influence by the accumulated charged particles 113.

Although this embodiment has described the case where the negative charged particles 113 that have accumulated at the interface between the liquid crystal layer 105 and the second alignment film 106 are dissociated from that interface, positive charged particles may accumulate at the interface between the liquid crystal layer 105 and the first alignment film 104. The control of the applied voltage similar to the above described control can cause the positive charged particles to be dissociated from the interface to suspend them in the liquid crystal layer 105. In this case, the voltage applied to the transparent electrode film 103 which is disposed on the side of the first alignment film 104 where the positive charged particles accumulate at the interface between the first alignment film 104 and the liquid crystal layer 105 may have the same positive sign as that of the charged particles.

Embodiment 2

As described in Embodiment 1, the long-time use of the projector causes cumulation of the negative charged particles 113 in the vicinity of the diagonal areas which are areas in a diagonal direction of the effective display area 112 of the liquid crystal layer 105 on the side of the second alignment film 106.

In this second embodiment (Embodiment 2), the charged particles 113 are drawn in a direction different from the diagonal direction along which the charged particles 113 have accumulated, and thereby the accumulated charged particles 113 are diffused (or moved) Constituent elements in this embodiment common to those of Embodiment 1 are denoted with the same reference numerals. This is also applied to embodiments described later.

Also in this embodiment, in the modulation operation state, the voltages applied to the transparent electrode film 103 and the reflective pixel electrode layer 107 are controlled such that the alternating electric field described in FIG. 9 is generated in the liquid crystal layer 105. This is also applied to other embodiments described later.

In the non-modulating operation state on the other hand, voltages are applied to the transparent electrode film 103 and the reflective pixel electrode layer 107 such that a difference between the voltages applied thereto (interelectrode electric potential difference) changes in the in-plane direction of the liquid crystal layer 105, that is, such that the interelectrode electric potential difference has an uneven distribution in the in-plane direction. Specifically, the voltages applied to the transparent electrode film 103 and the reflective pixel electrode layer 107 are controlled such that a larger interelectrode electric potential difference is provided for an area in the liquid crystal layer 105 where more charged particles accumulate. Such control of the applied voltage is performed for a predetermined time.

Figure 10:
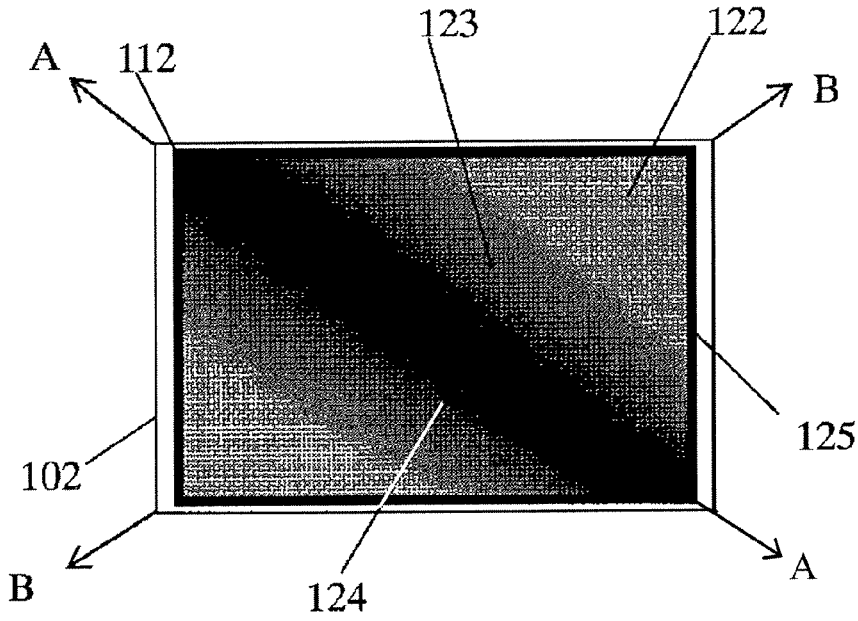
FIG. 10 shows an in-plane distribution provided to a reflective pixel electrode layer in order to diffuse the accumulated charged particles in Embodiment 2.

FIG. 10 shows the distribution of the voltage applied to the reflective pixel electrode layer 107 in the effective display area 112. An area 122 where the applied voltage is high is shown as a bright area. An area 123 where the applied voltage becomes gradually lower is shown as an area becoming gradually darker. An area 124 where the applied voltage is zero is shown as a black area. The effective area (effective pixel area) of the reflective pixel electrode layer 107 corresponding to the effective display area 112 is shown by a heavy line 125.

As can be seen from FIG. 10, the interelectrode electric potential difference is fixed in one diagonal direction A along which the charged particles 113 accumulate, and the interelectrode electric potential difference is 0 on the diagonal line in the diagonal direction A and in the area 124 at the vicinity of the diagonal line. On the other hand, the interelectrode electric potential difference is significantly changed in the other diagonal direction B such that it is larger as closer to the diagonal areas.

The area 122 is an area where the largest number of charged particles 113 accumulate, corresponding to a first area. The areas 123 and 124 correspond to a second area with respect to the area 122.

Figure 11:
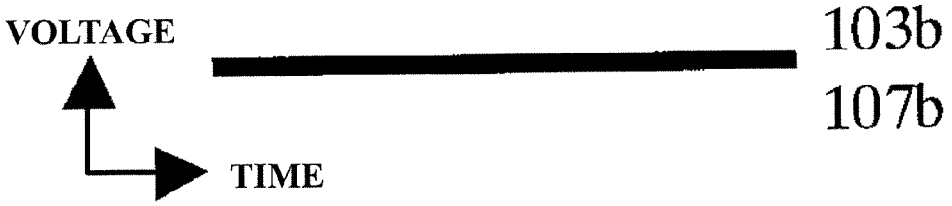
FIG. 11 shows a voltage applied to an area 124 of the opposite electrodes in FIG. 10 in Embodiment 2.
Figure 12:
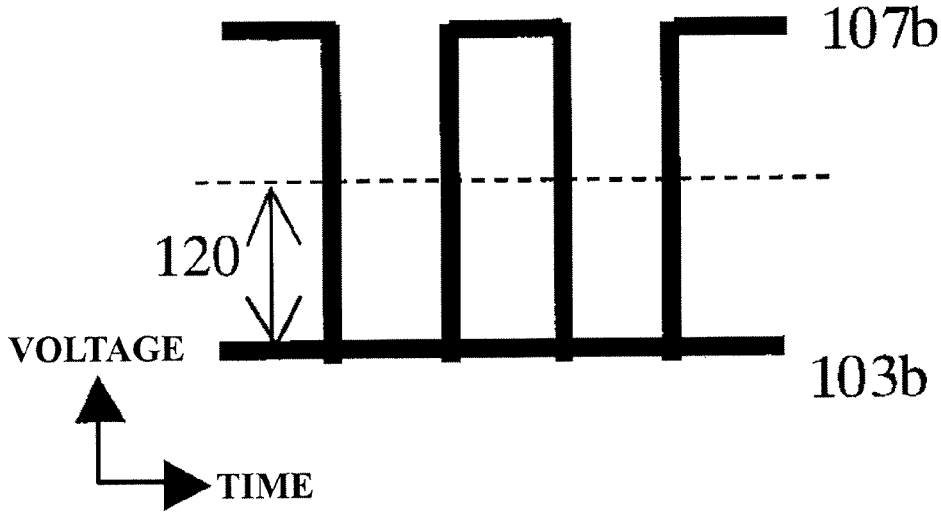
FIG. 12 shows a voltage applied to an area 122 of the opposite electrodes in FIG. 10 in Embodiment 2.
Figure 13:
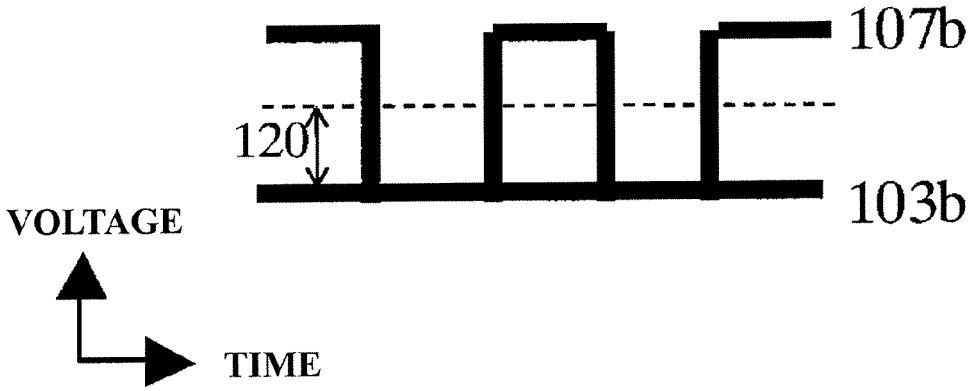
FIG. 13 shows a voltage applied to an area 123 of the opposite electrodes in FIG. 10 in Embodiment 2.

In this embodiment, the voltages applied to the electrode layers 103 and 107 (third and fourth electric potentials) are set as shown in FIGS. 11 to 13.

FIG. 11 shows the voltage applied in the area 124 shown in FIG. 10. The voltage **103*b* applied to the transparent electrode film 103 and the voltage 107***b* applied to the reflective pixel electrode layer 107 are fixed direct voltages that do not change with time. The applied voltages 103*b* and 107*b* are identical to each other, so that the interelectrode electric potential difference is 0.

The term "identical to each other" means not only a case where the applied voltages are completely identical to each other but also a case where the applied voltages have a difference due to control errors or the like within a range where the applied voltages can be regarded as being identical to each other. This is also applied to embodiments described later.

FIG. 12 shows the voltage applied in the area 122 shown in FIG. 10. The voltage 107*b* applied to the reflective pixel electrode layer 107 is an alternating voltage that has the minimum value identical to that of the voltage 103*b* applied to the transparent electrode film 103. The voltage 103*b* applied to the transparent electrode film 103 is a direct voltage.

Such control of the applied voltage is equivalent to applying, to the reflective pixel electrode layer 107, a positive direct voltage corresponding to a time-integral value (shown by a dotted line in FIG. 12) of the alternating voltage 107*b* applied to the reflective pixel electrode layer 107.

FIG. 13 shows the voltage applied in the area 123 shown in FIG. 10. As in the area 122, the voltage 107*b* applied to the reflective pixel electrode layer 107 is an alternating voltage that has the minimum value identical to the voltage 103*b* applied to the transparent electrode film 103. The voltage 103*b* applied to the transparent electrode film 103 is a direct voltage. However, the alternating voltage applied to the reflective pixel electrode layer 107 has the maximum value that is lower than the maximum value of the alternating voltage applied to the reflective pixel electrode layer 107 in the area 122.

Such control of the applied voltage is equivalent to applying, to the reflective pixel electrode layer 107, a positive direct voltage corresponding to the time-integral value (shown by the dotted line in FIG. 13) of the alternating voltage 107*b* applied to the reflective pixel electrode layer 107.

As a result, an interelectrode electric potential difference 120 larger than that provided to the area 123 is provided to the area 122. Thus, a higher direct voltage is applied to the area 122.

Figure 14:
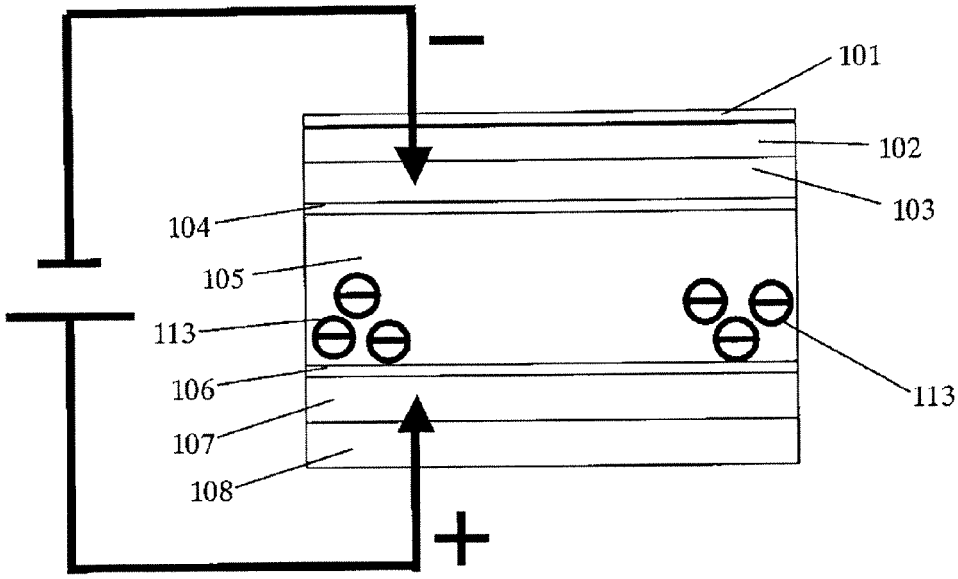
FIG. 14 shows a voltage applied to the opposite electrodes for diffusing the accumulated charged particles in Embodiment 2.

FIG. 14 shows a cross section of the structure of the liquid crystal panel. In this figure, the signs of the voltages applied to the liquid crystal layer 105 in the areas 122 and 123 other than the area 124 in which the voltage of 0 is applied to the liquid crystal layer 105. As described above, the voltage 107*b* applied to the reflective pixel electrode layer 107 is a positive voltage with respect to the voltage 103*b* applied to the transparent electrode film 103, so that a positive direct electric field that does not cyclically change between positive and negative electric field is generated in the liquid crystal layer 105.

The voltage applied to the reflective pixel electrode layer 107 which is disposed on the side of the second alignment film 106 where the charged particles 113 accumulate at the interface between the second alignment film 106 and the liquid crystal layer 105 has a positive sign different from that of the charged particles 113. However, as shown in FIG. 10, the voltage 107*b* applied to the reflective pixel electrode layer 107 increases toward the diagonal areas in the diagonal direction B different from the diagonal direction A along which the charged particles 113 accumulate.

Figure 15:
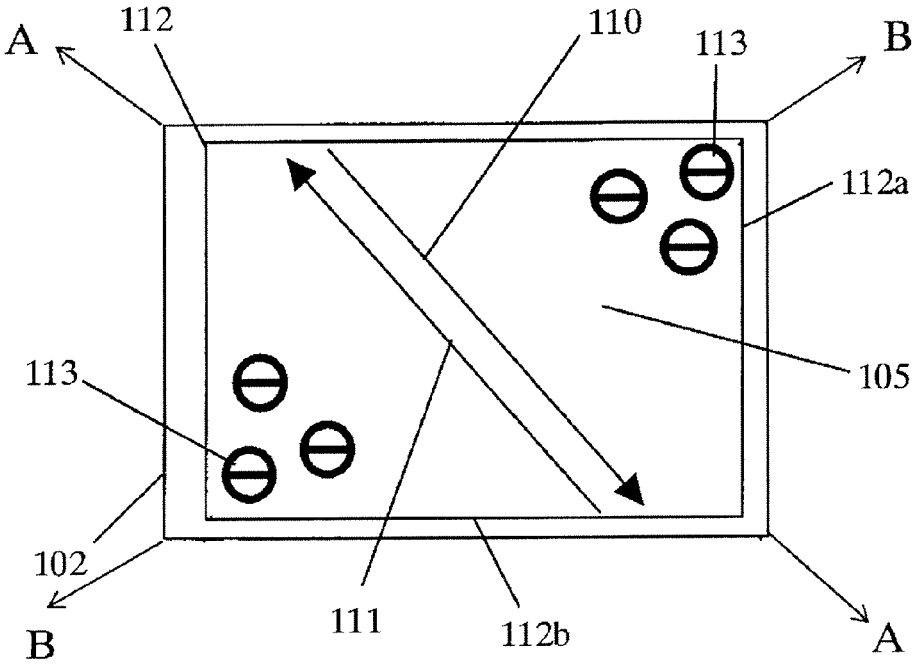
FIG. 15 shows a state where the accumulated charged particles are diffused in Embodiment 2.

Therefore, as shown in FIG. 15, the negative charged particles 113 that have accumulated at the interface between the second alignment film 106 and the liquid crystal layer 105 in the diagonal direction A are drawn by their coulomb forces in the diagonal direction B to be diffused in the liquid crystal layer 105.

The "predetermined time" in this embodiment means a time required for causing the most part (e.g., 70% or more) or all of the accumulated charged particles 113 to be diffused in the diagonal direction B in the liquid crystal layer 105.

Thus, the charged particles 113 that have accumulated in a specific diagonal direction can be diffused, thereby suppressing deterioratation of image quality due to the influence by the accumulation of the charged particles 113.

Embodiment 3

As described in Embodiment 2, the long-time use of the projector causes the negative charged particles 113 to accumulate in the vicinity of the diagonal areas in one diagonal direction on the side of the second alignment film 106, the diagonal areas being in the effective display area 112 of the liquid crystal layer 105.

In this third embodiment (Embodiment 3), as in Embodiment 2, the charged particles 113 are drawn in a diagonal direction different from the diagonal direction along which the charged particles 113 have accumulated to diffuse them in the non-modulating operation state. Specifically, as described in Embodiment 2 with reference to FIG. 10, voltages are applied to the transparent electrode film 103 and the reflective pixel electrode layer 107 such that a difference between the voltages applied thereto (interelectrode electric potential difference) changes in the in-plane direction of the liquid crystal layer 105. More specifically, the voltages applied to the transparent electrode film 103 and the reflective pixel electrode layer 107 are controlled such that a larger interelectrode electric potential difference is provided for an area in the liquid crystal layer 105 where more charged particles accumulate. Such control of the applied voltage is performed for a predetermined time.

Figure 16:
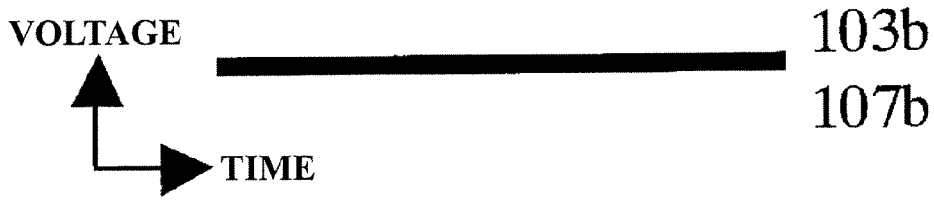
FIG. 16 shows a voltage applied to the area 124 of the opposite electrodes in FIG. 10 in Embodiment 3.
Figure 17:
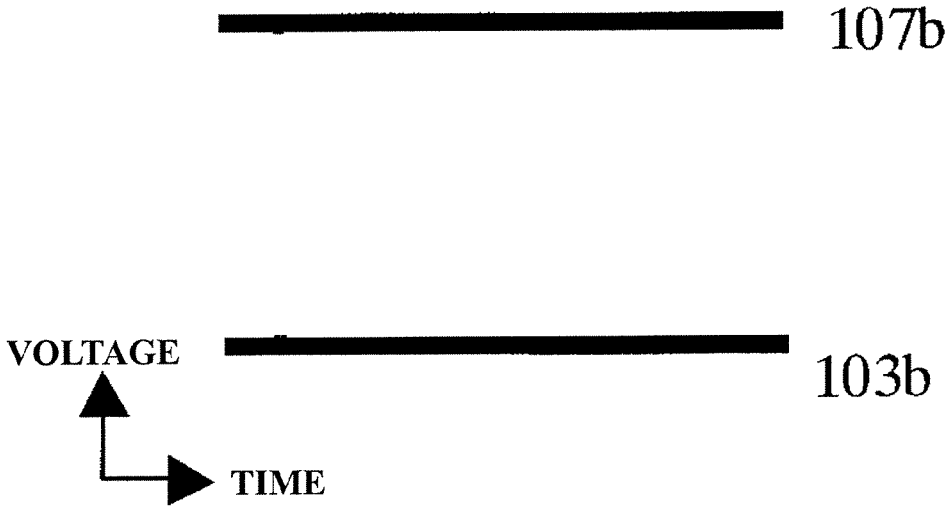
FIG. 17 shows a voltage applied to the area 122 of the opposite electrodes in FIG. 10 in Embodiment 3.
Figure 18:
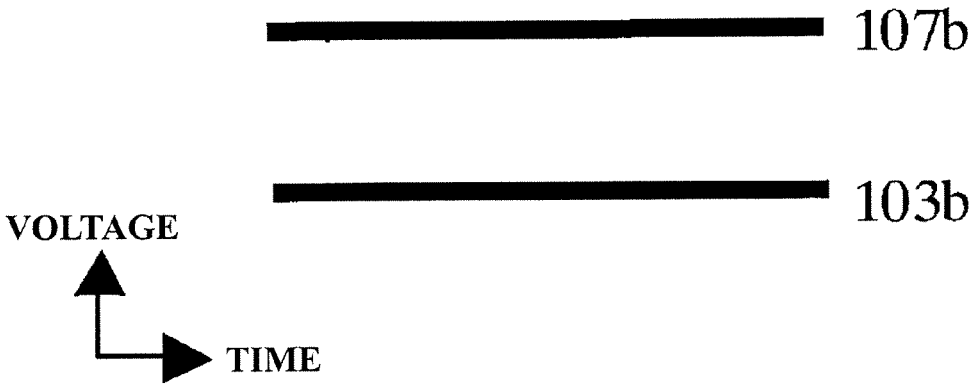
FIG. 18 shows a voltage applied to the area 123 of the opposite electrodes in FIG. 10 in Embodiment 3.

FIGS. 16 to 18 show the voltages applied to the electrode layers 103 and 107 for the predetermined time in this embodiment.

FIG. 16 shows the voltage applied in the area 124 in shown FIG. 10. The voltage 103*b* applied to the transparent electrode film 103 and the voltage 107*b* applied to the reflective pixel electrode layer 107 are fixed direct voltages that do not change with time. The applied voltages 103*b* and 107*b* are identical to each other, so that the voltage applied to the liquid crystal layer 105 is 0.

FIG. 17 shows the voltage applied in the area 122 shown in FIG. 10. The voltage 107*b* applied to the reflective pixel electrode layer 107 and the voltage 103*b* applied to the transparent electrode film 103 are direct voltages. The direct voltage applied to the reflective pixel electrode layer 107 is higher than that applied to the transparent electrode film 103, that is, a positive voltage is applied to the reflective pixel electrode layer 107.

FIG. 18 shows the voltage in the area 123 shown in FIG. 10. As in the area 122, the voltage 107*b* applied to the reflective pixel electrode layer 107 and the voltage 103*b* applied to the transparent electrode film 103 are direct voltages. The direct voltage applied to the reflective pixel electrode layer 107 is higher than that applied to the transparent electrode film 103, that is, a positive voltage is applied to the reflective pixel electrode layer 107. However, the voltage applied to the reflective pixel electrode layer 107 is lower than that applied to the reflective pixel electrode layer 107 in the area 122.

Consequently, a larger interelectrode electric potential difference is provided for the area 122 than that provided for the area 123, and thus a higher direct voltage is applied to the area 122 than that applied to the area 123.

Also in this embodiment, as described in Embodiment 2 with reference to FIG. 14, the voltage 107*b* applied to the reflective pixel electrode layer 107 in the areas 122 and 123 other than the area 124 is a positive voltage with respect to the voltage 103*b* applied to the transparent electrode film 103. Thus, a positive direct electric field that does not cyclically change between positive and negative electric fields is generated in the liquid crystal layer 105.

The voltage applied to the reflective pixel electrode layer 107 which is disposed on the side of the second alignment film 106 where the charged particles 113 accumulate at the interface between the second alignment film 106 and the liquid crystal layer 105 has a positive sign different from that of the charged particles 113. However, as can be seen from FIG. 10, the voltage 107*b* applied to the reflective pixel electrode layer 107 increases toward the diagonal areas in the diagonal direction B different from the diagonal direction A along which the charged particles 113 accumulate.

Therefore, as described in Embodiment 2 with reference to FIG. 15, the negative charged particles 113 that have accumulated in the diagonal direction A at the interface between the second alignment film 106 and the liquid crystal layer 105 are drawn by their coulomb forces in the diagonal direction B to be diffused in the liquid crystal layer 105.

The "predetermined time" means a time required for causing the most part (e.g., 70% or more) or all of the accumulated charged particles 113 to be diffused in the diagonal direction B in the liquid crystal layer 105.

Thus, the charged particles 113 that have accumulated in a specific diagonal direction can be diffused, thereby suppressing deterioratation of image quality due to the influence by the accumulation of the charged particles 113.

Since this embodiment applies the direct voltage to the reflective pixel electrode layer 107, when compared with the case described in Embodiment 2 in which the alternating voltage is applied to the reflective pixel electrode layer 107, the charged particles 113 can be always drawn by the coulomb forces in the diagonal direction B for the predetermined time, thus improving the effect to diffuse the charged particles 113.

Although Embodiments 2 and 3 have described the case where the negative charged particles 113 that have accumulated in the diagonal areas on the side of the second alignment film 106 are diffused, the positive charged particles may accumulate in the diagonal areas on the side of the first alignment film 104. These positive charged particles also can be diffused by the control of the applied voltage similar to that performed in each of Embodiments 2 and 3. In this case, the voltage applied to the transparent electrode film 103 which is disposed on the side of the first alignment film 104 where the positive charged particles accumulate at the interface between the first alignment film 104 and the liquid crystal layer 105 may have a negative sign different from that of the charged particles.

Embodiment 4

In a fourth embodiment (Embodiment 4) of the present invention, a first voltage application control (first control) described in Embodiment 1 (FIGS. 6 to 8) is performed to suspend the charged particles 113 that have accumulated at the interface between the second alignment film 106 and the liquid crystal layer 105 from that interface into the liquid crystal layer 105. Thereafter, a second voltage application control (second control) described in Embodiment 2 (FIGS. 10 to 15) or in Embodiment 3 (FIGS. 16 to 18) is performed. Specifically, the charged particles 113 are drawn in the diagonal direction B different from the diagonal direction A along which the charged particles 113 have accumulated in the effective display area 112 to diffuse the charged particles 113.

As described above, the first voltage application control and the second voltage application control are sequentially alternately performed. This can more effectively suppress the deterioration of image quality due to the influence by the charged particles 113 when compared with a case where only one of the first voltage application control and the second voltage application control.

The first voltage application control and the second voltage application control also may be performed in an order opposite to the above-described order.

Embodiment 5

Figure 19A:
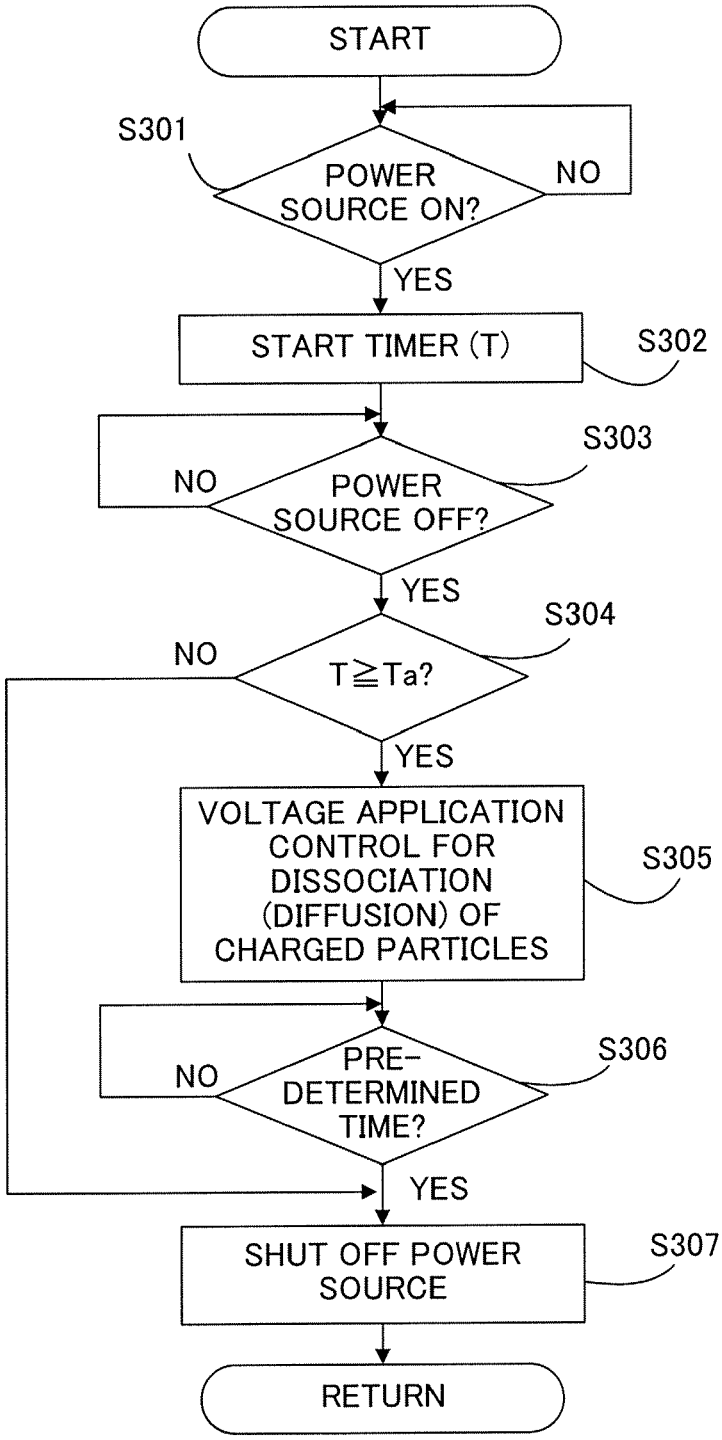
FIGS. 19A and 19B are a flowchart showing the operation of the liquid crystal projector in Embodiment 5.

Next, a liquid crystal projector that is a fifth embodiment (Embodiment 5) of the present invention will be described. The following section will describe a specific operation of the liquid crystal panel driver 3 that performs the control of the applied voltage for the dissociation or diffusion of the charged particles 113 described in Embodiments 1 to 4 with reference to the flowchart shown in FIG. 19A. This operation is performed based on a computer program stored in the liquid crystal panel driver 3.

At Step S301, the liquid crystal panel driver 3 determines whether or not a power source switch of the projector is turned on (power source ON). If the power source switch is turned on, the liquid crystal panel driver 3 causes an internal timer to start counting time at Step S302. This timer counts an integrated value (image display integrated time) T of the time during which the projector is in the modulation operation state (image display time) and adds the image display integrated time currently counted to the image display integrated time counted up to the previous operation.

When the power source switch is ON, the projector enters the image display state corresponding to the modulation operation state of the liquid crystal panel. The liquid crystal panel driver 3 performs the voltage application control shown in FIG. 9 to drive the liquid crystal panel to display (or project) an image.

Next, at Step S303, the liquid crystal panel driver 3 determines whether or not the power source switch is turned off. If the power source switch is not off, the liquid crystal panel driver 3 repeats the determination. If the power source switch is off, the liquid crystal panel driver 3 proceeds to Step S304.

At Step S304, the liquid crystal panel driver 3 regards the projector as having entered a non-image display state corresponding to the non-modulating operation state of the liquid crystal panel and determines whether or not the image display integrated time T counted by the above timer has reached a predetermined integrated time Ta. This predetermined integrated time Ta is set in advance as an expected time during which, in the liquid crystal panel, the charged particles 113 that have accumulated at the interface between the liquid crystal layer 105 and the second alignment film 106 or in the diagonal areas of the effective display area 112 may have an influence on the image quality. If the image display integrated time T has not reached the predetermined integrated time Ta, the liquid crystal panel driver 3 jumps to Step S307 to perform predetermined processing for completing the operation of the projector and subsequently shut off the power source.

If the image display integrated time T has reached the predetermined integrated time Ta on the other hand, the liquid crystal panel driver 3 proceeds to Step S305 to start the voltage application control described in Embodiments 1 to 4 for the dissociation or diffusion of the charged particles 113.

When performing the voltage application control described in Embodiments 1 to 3 at Step 305, the liquid crystal panel driver 3 determines at Step S306 whether or not that voltage application control has been performed for the predetermined time (predetermined time described in Embodiments 1 to 3). If the voltage application control has not yet been performed for the predetermined time, the liquid crystal panel driver 3 repeats the determination. If the voltage application control has been performed for the predetermined time, the liquid crystal panel driver 3 proceeds to Step S307 to perform the predetermined processing for completing the operation of the projector and subsequently shut off the power source.

Figure 19B:
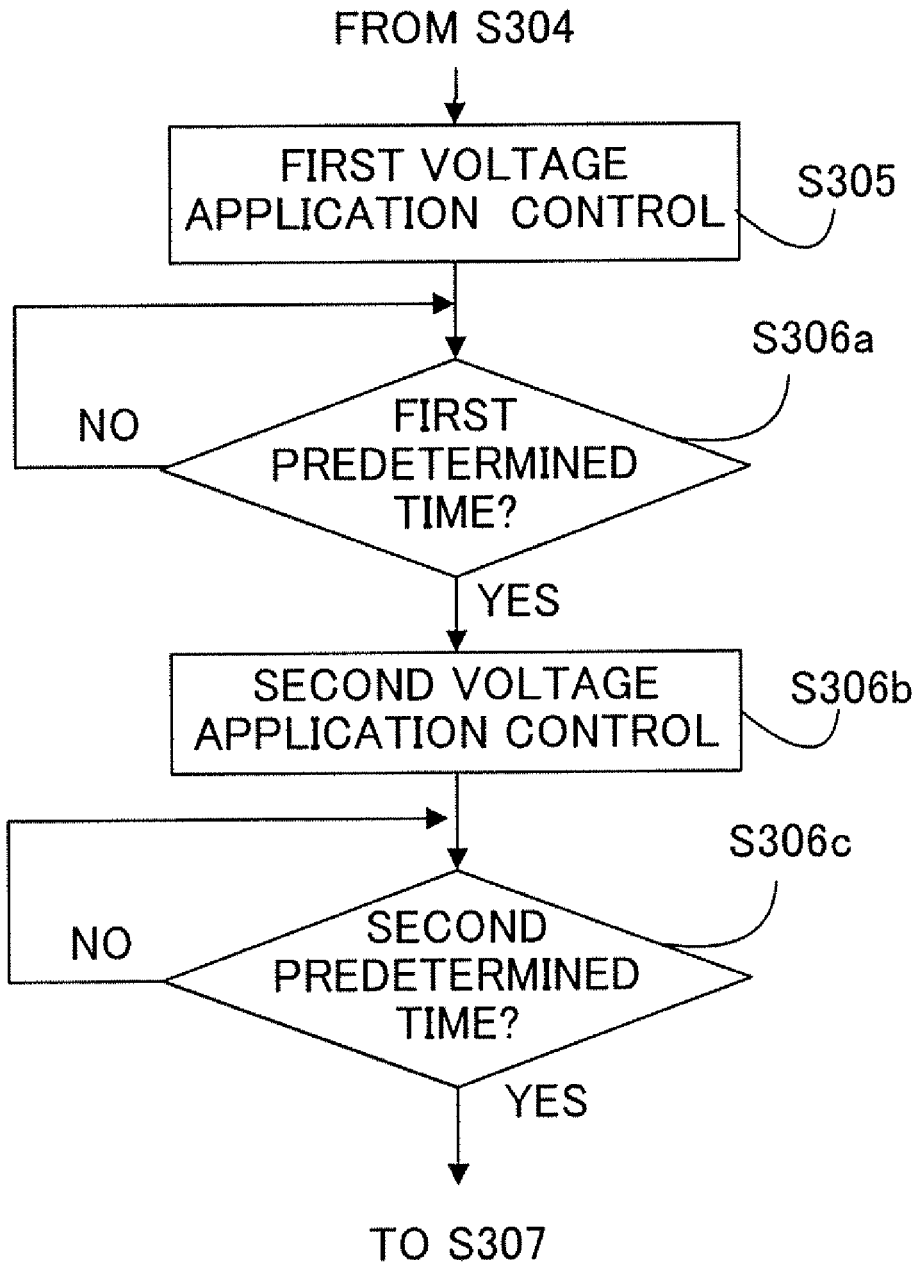

When performing the voltage application control described in Embodiment 4 at Step 305, the liquid crystal panel driver 3 determines at Step S306*a* shown in FIG. 19B whether or not the first voltage application control has been performed for the predetermined time described for example in Embodiment 1 (herein called as a first predetermined time). If the first voltage application control has not yet been performed for the first predetermined time, the liquid crystal panel driver 3 repeats the determination. If the first voltage application control has been performed for the first predetermined time, the liquid crystal panel driver 3 starts at Step S306*b* the second voltage application control. Then, as Step S306*c*, the liquid crystal panel driver 3 determines whether or not the second voltage application control has been performed for the predetermined time described in Embodiment 2 or 3 (herein called as a second predetermined time). If the second voltage application control has not yet been performed for the second predetermined time, the liquid crystal panel driver 3 repeats the determination. If the second voltage application control has been performed for the second predetermined time, the liquid crystal panel driver 3 proceeds to Step S307 to perform the predetermined processing for completing the operation of the projector and subsequently shut off the power source.

Although this embodiment has described the case where the voltage application control described in Embodiments 1 to 4 is performed in response to the passage of the predetermined image display integrated time during the power source of the projector being turned off. However, the voltage application control may be performed in a period from the turn-on of the power source of the projector to the entrance into the modulation operation state of the liquid crystal panel. Alternatively, the voltage application control may be performed at an arbitrary timing depending on an operation by the user. Further, the voltage application control may be performed whenever the power source of the projector is on or off regardless of the image display integrated time.

As described above, in each of the above-described embodiments, the third and fourth electric potentials are provided to the electrodes to which the first and second electric potentials are respectively provided in the modulation operation state. This can cause the charged particles that have attached to the interface between the liquid crystal layer and the alignment film or that have accumulated in the liquid crystal layer to be dissociated from the interface and diffused in the liquid crystal layer. Therefore, the deterioration of image quality due to the influence by the charged particles can be suppressed without adding a new configuration (or member) such as a switching part or an ion trap electrode to the liquid crystal modulation element.

Furthermore, the present invention is not limited to these embodiments and various variations and modifications may be made without departing from the scope of the present invention.

For example, although each of the above-described embodiments relates to the liquid crystal modulation element of the vertical alignment mode, the voltage application control of each of the above-described embodiments may be modified so as to be suitable for a liquid crystal modulation element of a mode other than the vertical alignment mode (e.g., TN mode, STN mode or OCB mode) to be applied thereto. Alternatively, the voltage application control of each of the above-described embodiments may be modified to have a form suitable for a transmissive liquid crystal modulation element.

This application claims the benefit of Japanese Patent Application No. 2007-154727, filed on Jun. 12, 2007, which is hereby incorporated by reference herein in its entirety.

What is claimed is:

1. A liquid crystal display apparatus, comprising:

a liquid crystal modulation element including a first electrode, a second electrode, a liquid crystal layer disposed between the first electrode and the second electrode, a first alignment film disposed between the first electrode and the liquid crystal layer, and a second alignment film disposed between the second electrode and the liquid crystal layer; and a controller that respectively provides a first electric potential and a second electric potential to the first electrode and the second electrode such that a sign of an electric field generated in the liquid crystal layer is cyclically inverted in a modulation operation state of the liquid crystal modulation element, wherein the controller respectively provides a third electric potential and a fourth electric potential to the first electrode and the second electrode such that the sign of the electric field generated in the liquid crystal layer is fixed in a state other than the modulation operation state, wherein the controller provides electric potentials whose difference changes in an in-plane direction of the liquid crystal layer as the third and fourth electric potentials respectively to the first and second electrodes, and wherein, when an area in which charged particles in the liquid crystal layer accumulate is defined as a first area and an area in which charged particles less than those in the first area accumulate is defined as a second area in the in-plane direction of the liquid crystal layer, the controller sets an electric potential difference between the third and fourth electric potentials in the second area to be larger than that in the first area.

2. The liquid crystal display apparatus according to claim 1, wherein the controller provides the third or fourth electric potential to the first or second electrode such that a relative electric potential provided to one of the first and second electrodes which is disposed on a side of the alignment film where charged particles in the liquid crystal layer accumulate at an interface between the alignment film where the charged particle accumulate and the liquid crystal layer has a same sign as that of the charged particles relative to the electric potential provided to the other electrode.

3. The liquid crystal display apparatus according to claim 1, wherein the controller provides, to one of the first and second electrodes which is disposed on a side of the alignment film where charged particles in the liquid crystal layer accumulate at an interface between the alignment film where the charged particles accumulate and the liquid crystal layer, the third or fourth electric potential having a sign different from that of the charged particles.

4. The liquid crystal display apparatus according to claim 1, wherein the controller sequentially performs:

a first control to respectively provide electric potentials each fixed in an in-plane direction of the liquid crystal layer as the third and fourth electric potentials to the first and second electrodes; and a second control to respectively provide electric potentials whose difference changes in the in-plane direction of the liquid crystal layer as the third and fourth electric potentials to the first and second electrodes.

5. A liquid crystal display apparatus, comprising:

a liquid crystal modulation element including a first electrode, a second electrode, a liquid crystal layer disposed between the first electrode and the second electrode, a first alignment film disposed between the first electrode and the liquid crystal layer, and a second alignment film disposed between the second electrode and the liquid crystal layer; and a controller that respectively provides a first electric potential and a second electric potential to the first electrode and the second electrode such that a sign of an electric field generated in the liquid crystal layer is cyclically inverted in a modulation operation state of the liquid crystal modulation element, wherein the controller respectively provides a third electric potential and a fourth electric potential to the first electrode and the second electrode such that the sign of the electric field generated in the liquid crystal layer is fixed in a state other than the modulation operation state, wherein the controller provides electric potentials whose difference changes in an in-plane direction of the liquid crystal layer as the third and fourth electric potentials respectively to the first and second electrodes, wherein, when an area in which charged particles in the liquid crystal layer accumulate is defined as a first area and an area in which charged particles less than those in the first area accumulate is defined as a second area in the in-plane direction of the liquid crystal layer, the controller sets an electric potential difference between the third and fourth electric potentials in the second area to be larger than that in the first area, and wherein the liquid crystal modulation element is a reflective liquid crystal modulation element of a vertical alignment mode.

6. An image display system, comprising:

the liquid crystal display apparatus according to claim 1; and an image supply apparatus that supplies image information to the liquid crystal display apparatus.

* * * * *